US010093999B2

(12) United States Patent
Liu et al.

(10) Patent No.: US 10,093,999 B2
(45) Date of Patent: Oct. 9, 2018

(54) STEEL PLATE RESISTANT TO ZINC-INDUCED CRACK AND MANUFACTURING METHOD THEREFOR

(71) Applicant: BAOSHAN IRON & STEEL CO., LTD., Shanghai (CN)

(72) Inventors: Zicheng Liu, Shanghai (CN); Yong Wu, Shanghai (CN); Xianju Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 324 days.

(21) Appl. No.: 14/782,965

(22) PCT Filed: Mar. 5, 2014

(86) PCT No.: PCT/CN2014/072890
§ 371 (c)(1),
(2) Date: Oct. 7, 2015

(87) PCT Pub. No.: WO2014/201877
PCT Pub. Date: Dec. 24, 2014

(65) Prior Publication Data

US 2016/0097111 A1 Apr. 7, 2016

(30) Foreign Application Priority Data

Jun. 19, 2013 (CN) ..... 2013 1 0244713

(51) Int. Cl.
*C21D 9/46* (2006.01)
*C22C 38/14* (2006.01)
(Continued)

(52) U.S. Cl.
CPC ..... *C21D 9/46* (2013.01); *B22D 11/001* (2013.01); *C21D 6/001* (2013.01); *C21D 6/005* (2013.01);
(Continued)

(58) Field of Classification Search
CPC ..... B22D 11/001; C21D 2211/002; C21D 2211/004; C21D 2211/005; C21D 6/001;
(Continued)

(56) References Cited

U.S. PATENT DOCUMENTS

2014/0246128 A1* 9/2014 Takashima ..... B21B 1/26 148/541

FOREIGN PATENT DOCUMENTS

CN 1715434 A 1/2006
CN 101289728 A 10/2008
(Continued)

OTHER PUBLICATIONS

PCT International Search Report, PCT/CN2014/072890, dated Jun. 11, 2014, 4 pages.

*Primary Examiner* — Veronica F Faison
(74) *Attorney, Agent, or Firm* — Quarles & Brady LLP

(57) ABSTRACT

The invention discloses a steel plate resistant to zinc-induced crack and a manufacturing method therefor. A low-alloy steel subjected to low C-ultra low Si-high Mn-low Al—(Ti+Nb) microalloying treatment is taken as a basis; the Al content in the steel is appropriately reduced; the conditions are controlled so that Mn/C≥15, [(% Mn)+0.75(% Mo)]×(% C)≤0.16, Nb/Ti≥1.8 and Ti/N is between 1.50 and 3.40, CEZ≤0.44% and the B content is ≤2 ppm, Ni/Cu≥1.50; a Ca treatment is performed and the Ca/S ratio is controlled between 1.0 and 3.0, with (% Ca)×(% S)$^{0.28}$≤1.0×10$^{-3}$; and a TMCP process is optimized, so that a finished steel plate has a micro-structure of ferrite+bainite colonies which are tiny and dispersedly distributed, with an average grain size of not greater than 10 μm, has homogeneous and excellent mechanical properties, excellent weldability and zinc-induced crack resistance, and is thus especially suitable as a zinc-spray coated corrosion-resistant steel plate for marine structures, a zinc-spray corrosion-resistant steel plate for
(Continued)

extra-high voltage power transmission structures, a zinc-spray coated corrosion-resistant steel plate for coast bridge structures, and the like.

3 Claims, 1 Drawing Sheet

(51) Int. Cl.

| | |
|---|---|
| ***B22D 11/00*** | (2006.01) |
| ***C21D 8/02*** | (2006.01) |
| ***C21D 9/42*** | (2006.01) |
| ***C21D 6/00*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C23C 26/00*** | (2006.01) |

(52) U.S. Cl.
CPC ..... *C21D 6/008* (2013.01); *C21D 8/0205* (2013.01); *C21D 8/0226* (2013.01); *C21D 8/0247* (2013.01); *C21D 8/0263* (2013.01); *C21D 9/42* (2013.01); *C22C 33/04* (2013.01); *C22C 38/001* (2013.01); *C22C 38/002* (2013.01); *C22C 38/02* (2013.01); *C22C 38/04* (2013.01); *C22C 38/08* (2013.01); *C22C 38/12* (2013.01); *C22C 38/14* (2013.01); *C22C 38/16* (2013.01); *C23C 26/00* (2013.01); *C21D 2211/002* (2013.01); *C21D 2211/004* (2013.01); *C21D 2211/005* (2013.01)

(58) Field of Classification Search
CPC ..... C21D 6/005; C21D 6/008; C21D 8/0205; C21D 8/0226; C21D 8/0247; C21D 8/0263; C21D 9/42; C21D 9/46; C22C 33/04; C22C 38/001; C22C 38/002; C22C 38/02; C22C 38/04; C22C 38/08; C22C 38/12; C22C 38/14; C22C 38/16; C23C 26/00
See application file for complete search history.

(56) References Cited

FOREIGN PATENT DOCUMENTS

| | | | | |
|---|---|---|---|---|
| CN | 102719745 | A | 10/2012 | |
| CN | 103320693 | A | 9/2013 | |
| JP | 2005240051 | A | 9/2005 | |
| WO | WO-2013046697 | A1 * | 4/2013 | ..... B21B 1/26 |

* cited by examiner

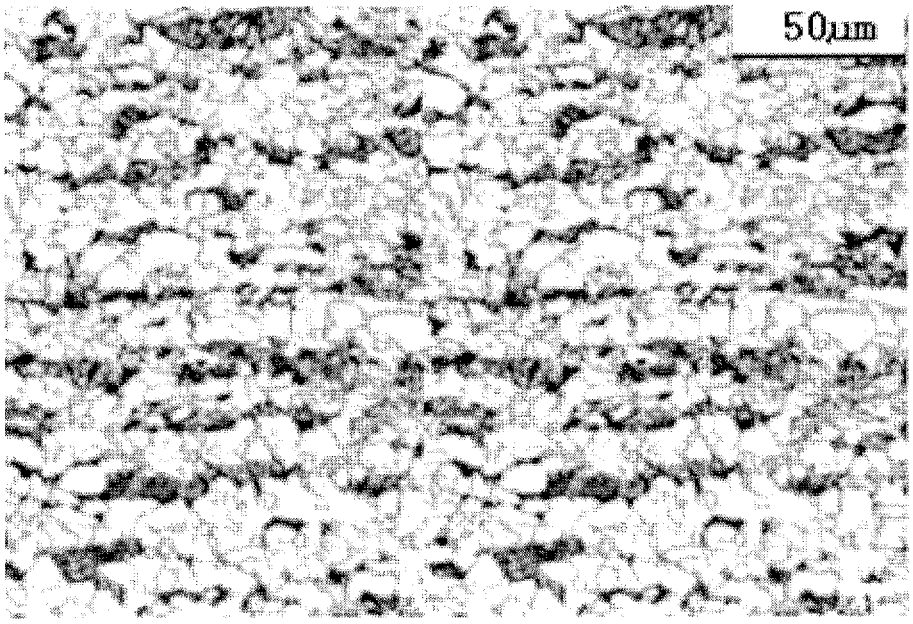
50μm

STEEL PLATE RESISTANT TO ZINC-INDUCED CRACK AND MANUFACTURING METHOD THEREFOR

CROSS-REFERENCE TO RELATED APPLICATIONS

This application represents the national stage entry of PCT International Application No. PCT/CN2014/072890 filed Mar. 5, 2014, which claims priority of Chinese Patent Application No. 201310244713.8 filed Jun. 19, 2013, the disclosures of which are incorporated by reference here in their entirety for all purposes.

FIELD OF THE INVENTION

The present invention relates to a structural steel and a manufacturing method therefor, and in particular to a steel plate resistant to zinc-induced crack and a manufacturing method therefor, wherein the steel plate has a yield strength of ≥460 MPa, a tensile strength of ≥550 MPa, and an impact energy at −60° C. (single value) of ≥47 J, and is resistant to zinc-induced crack (CEZ≤0.44%). The microstructure of a finished steel plate is ferrite+bainite colonies which are tiny and dispersedly and homogeneously distributed, with an average grain size controlled at not greater than 10 μm, and the micro-structure of a welding heat-affected zone is tiny and homogeneous ferrite+a small amount of pearlite.

BACKGROUND

It is well known that a low-carbon (high-strength) and low-alloy steel is one of the most important engineering structural materials, and is widely applied to petroleum and natural gas pipelines, ocean platforms, shipbuilding, bridges, pressure vessels, building structures, automobile industry, railway transportation and machine manufacturing. The performance of the low-carbon (high-strength) and low-alloy steel depends on the chemical components and the process system in the manufacturing process thereof, wherein the strength, toughness and weldability are the most important performances of the low-carbon (high-strength) and low-alloy steel, and it is eventually determined by the micro-structure state of the finished steel product. As science and technology is continuously developing forward, people propose higher requirements for the strength-toughness and weldability of the steel, i.e. greatly improving the performance of the steel plate while maintaining relatively low manufacturing costs, so as to decrease the usage amount of the steel and save costs, reduce its own weight of the steel structure, and improve the safety of the structure.

Since the end of the 20th century to now, a research climax of developing a next generation of steel materials is aroused worldwide, which requires obtaining a better structure matching through optimizing the alloy combination design and renovating the TMCP process technique, without any increase in the contents of noble alloy elements such as Ni, Cr, Mo and Cu, etc., thereby obtaining a higher strength-toughness, a better weldability, and the adaptation of welded joints to the spraying method with various metals of Al and Zn etc.

When manufacturing a thick steel plate having a yield strength of ≥415 MPa and a low-temperature impact toughness at −60° C. of ≥34 J in the prior art, a certain amount of Ni or Cu+Ni elements (≥0.30%) are generally added, for example [The Firth (1986) international Symposium and Exhibit on Offshore Mechanics and Arctic Engineering, 1986, Tokyo, Japan, 354; "DEVELOPMENTS IN MATERIALS FOR ARCTIC OFFSHORE STRUCTURES"; "Structural Steel Plates for Arctic Use Produced by Multi-purpose Accelerated Cooling System" (Japanese), Kawaseki Seitetsu Gihou, 1985, No. 1 68-72; "Application of Accelerated Cooling For Producing 360 MPa Yield Strength Steel plates of up to 150 mm in Thickness with Low Carbon Equivalent", Accelerated Cooling Rolled Steel, 1986, 209-219; "High Strength Steel Plates For Ice-Breaking Vessels Produced by Thermo-Mechanical Control Process", Accelerated Cooling Rolled Steel, 1986, 249-260; "420 MPa Yield Strength Steel Plate with Superior Fracture Toughness for Arctic Offshore Structures", Kawasaki steel technical report, 1999, No. 40, 56; "420 MPa and 500 MPa Yield Strength Steel Plate with High HAZ toughness Produced by TMCP for Offshore Structure", Kawasaki steel technical report, 1993, No. 29, 54; "Toughness Improvement in Bainite Structure by Thermo-Mechanical Control Process" (Japanese), Sumitomo Metal, Vol. 50, No. 1 (1998), 26; "Structural Steel Plates for Ocean Platform used in Frozen Sea Areas" (Japanese), Research on Iron and Steel, 1984, No. 314, 19-43], so as to ensure that the steel plate as the base material has an excellent low-temperature toughness, the toughness of the heat-affected zone HAZ also can reach Akv≥34 J at −60° C. when welding with a heat input of <100 KJ/cm; however, the steel plate does not involve a resistance to zinc-induced crack.

The above-mentioned large number of patent documents only demonstrate how to achieve the low-temperature toughness of the steel plate as the base material, and explain less about how to obtain the excellent low-temperature toughness of the heat-affected zone (HAZ) under a welding condition, and even do not relate to how to ensure that the structure of the heat-affected zone is homogeneous and tiny ferrite+a small amount of pearlite especially when welding using a high heat input, enable the ferrite to nucleate and grow on the prior austenite grain boundary, substantially eliminate the prior austenite grain boundary, and improve the resistance to zinc-induced crack of the steel plate, such as Japan patents S 63-93845, S 63-79921, S 60-258410, Published Patent H 4-285119, Published Patent H 4-308035, H 3-264614, H 2-250917, H 4-143246 and U.S. Pat. No. 4,855,106, U.S. Pat. No. 5,183,198, U.S. Pat. No. 4,137,104 etc.

At present, only Nippon Steel Corporation adopts an oxide metallurgical technology for improving the low-temperature toughness of the heat-affected zone (HAZ) when using a high heat input welding for the steel plate, and this patent also does not involve how to improve the zinc-induced-crack-resistance of the steel plate, see U.S. Pat. No. 4,629,505 and WO 01/59167A1.

SUMMARY OF THE INVENTION

The object of the present invention is to provide a steel plate resistant to zinc-induced crack and a manufacturing method therefor, wherein the steel plate has a yield strength of ≥460 MPa, a tensile strength of ≥550 MPa, and an impact energy at −60° C. (single value) of ≥47 J, and is resistant to zinc-induced crack (CEZ≤0.44%). The micro-structure of a finished steel plate is ferrite+bainite colonies which are tiny and dispersedly and homogeneously distributed, with an average grain size controlled at not greater than 10 μm, and the micro-structure of a welding heat-affected zone is tiny and homogeneous ferrite+a small amount of pearlite. More importantly, the austenite grain boundary formed at high temperature during the weld thermal cycle is completely eliminated, while ensuring the good mechanical properties and weldability of the steel plate as the base material, the welded joints, especially the welding heat-affected zone, of the steel plate has an excellent resistance to zinc-induced crack, the unity of a high strength, good weldability and resistance to zinc-induced crack is achieved, and the steel plate is particularly suitable as a zinc-spray coated corrosion-resistant steel plate for marine structures, a zinc-spray corrosion-resistant steel plate for extra-high voltage power transmission structures, a zinc-spray coated corrosion-resistant steel plate for coast bridge structures, and the like.

In order to achieve the above-mentioned object, the technical solution of the present invention is as follows:

the present invention adopts a low-alloy steel subjected to low C-ultra low Si-high Mn-low Al—(Ti+Nb) microalloying treatment as a basis, and metallurgical technological means are used, for example, appropriately reducing the Al content in the steel, controlling the conditions so that Mn/C≥15, [(% Mn)+0.75(% Mo)]×(% C)≤0.16, Nb/Ti≥1.8 and Ti/N is between 1.50 and 3.40, CEZ≤ 0.44% and the B content is ≤2 ppm, Ni/Cu≥1.50; performing a Ca treatment, and controlling the Ca/S ratio being between 1.0 and 3.0, with (% Ca)×(% S)$^{0.28}$≤ $1.0\times10^{-3}$ etc., and a TMCP (Thermo-mechanical control process) process is optimized, so that a finished steel plate has a micro-structure of tiny ferrite+bainite colonies dispersedly distributed, with an average grain size controlled at not greater than 10 μm, obtaining homogeneous and excellent mechanical properties, excellent weldability and resistance to zinc-induced crack, and is thus especially suitable as a zinc-spray coated corrosion-resistant steel plate for marine structures, a zinc-spray corrosion-resistant steel plate for extra-high voltage power transmission structures, a zinc-spray coated corrosion-resistant steel plate for coast bridge structures, and the like.

In particular, the steel plate resistant to zinc-induced crack of the present invention has the following components by weight percentages:

C: 0.05%-0.090%
Si: ≤0.20%
Mn: 1.35%-1.65%
P: ≤0.013%
S: ≤0.003%
Cu: 0.10%-0.30%
Ni: 0.20%-0.50%
Mo: 0.05%-0.20%
Nb: 0.015%-0.035%
Ti: 0.008%-0.018%
N: ≤0.0060%
Ca: 0.0010%-0.0040%
B: ≤0.0002%, and
the balance being Fe and inevitable impurities;

and at the same time the above-mentioned element contents must satisfy the relationships as follows:

Mn/C≥15, such that the micro-structure of the finished steel plate is tiny ferrite+dispersedly distributed bainite colonies, and the impact transformation temperature of the steel plate is lower than −60° C.

[(% Mn)+0.75(% Mo)]×(% C)≤0.16, such that it is ensured that in a broad range of welding heat input (10 kJ/cm−50 kJ/cm), the structure of the welding heat-affected zone is ferrite+pearlite or bainite colonies dispersedly distributed, the prior austenite grain boundary in the welding heat-affected zone is eliminated, and the resistance to zinc-induced crack of the steel plate is improved; this is one of the keys for the steel component design of the present invention.

CEZ≤0.44%, and the B content is ≤2 ppm, wherein,

CEZ=C+Si/17+Mn/7.5+Cu/13+Ni/17+Cr/4.5+Mo/3+V/1.5+Nb/2+Ti/4.5+420B, so as to control the phase transformation process from austenite to ferrite in the welding heat-affected zone, inhibit the nucleation and growth of the bainite from the prior austenite grain boundary, destroy the prior austenite grain boundary, and eliminate the generation of zinc-induced cracks in the welded joints of the steel plate. This is also one of the keys for the steel component design of the present invention.

Ni/Cu≥1.50, so as to prevent the reheat embrittlement during the high heat input welding, while preventing Cu from segregating on the grain boundary, improving the copper brittleness and resistance to zinc-induced crack, and improving the low-temperature impact toughness of the TMCP steel plate (an accelerated-cooled steel plate).

Nb/Ti≥1.8 and Ti/N is between 1.50 and 3.40, such that the Ti(C,N) and Nb(C,N) particles formed are ensured to be tiny and distributed in the steel in a state of homogeneous dispersion, more importantly, the degree of Ostwald ripening of Ti(C,N) (i.e. large grains continue to grow up, while small grains shrink or disappear) is low, the Ti(C,N) particles are ensured to be maintained homogeneous and tiny during the heating of the slab and during the weld thermal cycle of the steel plate, the micro-structures of the steel plate as the base material and the welding heat-affected zone are refined, the formation of the micro-structure of ferrite+pearlite in the welding heat-affected zone is facilitated, the low-temperature impact toughness of the welding heat-affected zone is improved, the prior austenite grain boundary in the welding heat-affected zone is eliminated, and the resistance to zinc-induced crack of the steel plate is improved.

Ca/S is between 1.00 and 3.00, and (% Ca)×(% S)$^{0.28}$≤$1.0\times10^{-3}$, such that the inclusions in the steel have a low content and are homogeneously and tinily dispersed in the steel, and the low-temperature toughness of the steel plate and the toughness of the welding HAZ are improved.

A finished steel plate has a yield strength of ≥460 MPa, a tensile strength of ≥550 MPa, and an impact energy at −60° C. (single value) of ≥47 J. The micro-structure of the finished steel plate is ferrite+bainite colonies which are tiny and dispersedly and homogeneously distributed, with an average grain size controlled at not greater than 10 μm, and the micro-structure of the welding heat-affected zone is tiny and homogeneous ferrite+a small amount of pearlite.

In the component design of the present invention:

C has a great effect on the strength, low-temperature toughness, weldability and zinc-induced-crack-resistance of the steel, from improving the low-temperature toughness, weldability and zinc-induced-crack-resistance of the steel, it is desired to control the C content in the steel to be lower; but from the perspective of the strength of the steel and the micro-structure control during the production and manufacture, the C content should not be excessively low, an excessively low C content (<0.05%) causes not only the temperatures of points $Ac_1$, $Ac_3$, $Ar_1$ and $Ar_3$ to be relatively high, but also the migration rate of the austenite grain boundary to be excessively high, which bring about great difficulties in grain refinement, easily form a mixed crystal structure and result in a poor low-temperature toughness of the steel and the serious degradation of the low-temperature toughness of the heat-affected zone under ultra-high heat input welding; moreover, when the C content is excessively low, it is necessary to add a large amount of alloy elements such as Cu, Ni, Cr, Mo, etc., which results in the manufacturing costs of the steel plate to remain high, and therefore the lower control limit of the C content in the steel should not be lower than 0.05%. When the C content is increased, although it is obviously advantageous for the refinement of the micro-structure of the steel plate, the weldability of the steel plate is impaired, especially under the condition of high heat input welding, due to the serious coarsening of the grains in the heat-affected zone (HAZ) and a very low cooling rate during the cooling in the weld thermal cycle, coarse abnormal structures such as ferrite side-plate (FSP), Widmannstatten structure (WF) and upper bainite (Bu) are easily formed in the heat-affected zone (HAZ), more importantly, the austenite grain boundary formed at high temperature during the weld thermal cycle is completely preserved, the resistance to zinc-induced crack is seriously deteriorated, and therefore the C content should not be higher than 0.09%; in addition, when the C content is higher than 0.09%, the liquid steel solidifies and enters a peritectic reaction zone, the segregation of the steel plate is ensured to be dramatically increased, the carbon equivalent and CEZ in the segregation zone are dramatically increased, and the zinc-induced-crack-resistance sensibility is caused to be substantially increased.

As the most important alloy element in the steel, Mn, in addition to improving the strength of the steel plate, also has the function of enlarging the austenite phase region, decreasing the temperature of the $Ar_3$ point, refining the ferrite grains to improve the low-temperature toughness of the steel plate, and facilitating the formation of bainite to improve the strength of the steel plate; therefore the controlled Mn content in the steel should not be lower than 1.35%. Mn is prone to segregate during the solidification of the liquid steel, especially an excessively high Mn content not only would make the continuous casting operation difficult, but also would be easily subjected to a conjugate segregation phenomenon with elements such as C, P and S, which aggravates the segregation and looseness of the centre of the continuous casting slab, and a serious centre segregation of the continuous casting slab easily forms abnormal structures during the subsequent controlled rolling and welding; at the same time, the excessively high Mn content also would form coarse MnS particles, and such coarse MnS particles extend along the rolling direction during the hot rolling, seriously deteriorate the impact toughness of the steel plate as the base material (in particular transversely), the welding heat-affected zone (HAZ) [in particular under the condition of high heat input welding], and cause a poor Z-direction property and a poor lamellar tearing-resistant property; in addition, the excessively high Mn content would also improve the hardenability of the steel, improve the welding cold crack sensitivity coefficient (Pcm) and the zinc-induced-crack-resistance index CEZ in the steel, impact the welding manufacturability of the steel, facilitate the formation of low-temperature phase transformation structures, preserve the austenite grain boundary formed at high temperature during the weld thermal cycle, and seriously deteriorate the zinc-induced-crack-resistance. Therefore, the upper limit of the Mn content in the steel can not exceed 1.65%.

Si promotes the deoxidization of the liquid steel and can improve the strength of the steel plate, but using the liquid steel deoxidized with Al, the deoxidzation of Si is insignificant; although Si can improve the strength of the steel plate, Si seriously impairs the low-temperature toughness and weldability of the steel plate, in particular under the condition of high heat input welding, Si not only facilitates the formation of M-A islands, the formed M-A islands being large in size and unevenly distributed and seriously impairing the toughnes of the welding heat-affected zone (HAZ), but also enlarges the moderate temperature-phase change region, facilitates the formation of bainite, causes the prior austenite grain boundary to be completely preserved, and seriously deteriorates the zinc-induced-crack-resistance of the welding heat-affected zone; furthermore, when the Si content in the steel is excessively high, the zinc-spray adhesiveness of the steel plate decreases, and influences the zinc-spray effect of the steel plate; therefore, the Si content in the steel should be controlled as low as possible, and with the consideration of economy and operability in the process of steel-making, the Si content is controlled at not greater than 0.20%.

Although P, as a harmful inclusion in the steel, segregates in the prior austenite grain boundary, and can inhibit the diffusion of Zn towards the grain boundary and decrease the sensibility to the occurrence of zinc-induced cracks, P seriously weakens the grain boundary, seriously deteriorates the mechanical properties of the steel plate, especially the low-temperature impact toughness and weldability, and facilitates the intergranular brittle failure of the welding heat-affected zone, with the comprehensive result being that improving the P content in the steel is more harm than good; therefore, in theory it is better to require lower P, but with the consideration of the steel-making operability and the steel-making costs, for the requirements of high heat input welding and resistance to zinc-induced crack, the P content needs to be controlled at ≤0.013%.

Although S, as a harmful inclusion in the steel, segregates in the prior austenite grain boundary, and can inhibit the diffusion of Zn towards the grain boundary and decrease the sensibility to the occurrence of zinc-induced cracks, S combines with Mn in the steel to form a MnS inclusion, and during the hot rolling, the plasticity of the MnS allows MnS to extend along the rolling direction and form a MnS inclusion band along the rolling direction, which seriously deteriorates the lateral impact toughness, Z-direction property and weldability of the steel plate; at the same time, S is also a main element for producing hot brittleness during the hot rolling, with the comprehensive result being that improving the S content in the steel is more harm than good; therefore, in theory it is better to require lower S, but with the consideration of the steel-making operability, the steel-making costs and the principle of smooth material flow, for the requirements of high heat input welding and zinc-induced-crack-resistance, the S content needs to be controlled at 0.003%.

As an austenite-stabilizing element, adding a small amount of Cu can simultaneously improve the strength and weather resistance of the steel plate and improve the low-temperature toughness without impairing the weldability; however, when being added excessively (Cu>0.30%), Cu, as a surface-active element, usually segregates in the grain boundary between austenite and ferrite, facilitates the formation of low-temperature phase transformation structures in the welding heat-affected zone to preserve the prior austenite grain boundary, and seriously deteriorates the resistance to zinc-induced crack of the steel plate, and therefore the Cu content is controlled between 0.10% and 0.30%.

Ni is the only alloy element for the steel plate to obtain a good ultra low-temperature toughness without impairing the weldability, and is also an indispensable alloy element for a cryogenic steel; more importantly, the addition of Ni in the steel can inhibit the segregation of Cu in the grain boundary between austenite and ferrite, suppress the grain boundary embrittlement of Cu to improve the resistance to zinc-induced crack of the steel plate; when the addition amount is excessively low (Ni<0.20%), the function thereof is insignificant and can not effectively inhibit the grain boundary embrittlement caused by Cu; when the addition amount is excessively high (Ni>0.50%), it facilitates the formation of low-temperature phase transformation structures in the welding heat-affected zone to preserve the prior austenite grain boundary and deteriorates the resistance to zinc-induced crack of the steel plate; therefore, the Ni content is controlled between 0.20% and 0.50%.

Adding an appropriate content of Mo not only can make up for the insufficient strength caused by ultralow C component design and improve the strength-toughness matching and low-temperature toughness of the steel plate, but also can improve the weldability, especially high heat input weldability brought about by the significant reduction of C content and enhance the toughness of the welding heat-affected zone; when the addition amount is excessively low (Mo<0.05%), the phase transformation strengthening function in the TMCP process is insufficient, and the strength-toughness matching of the steel plate cannot be achieved; when the addition amount is excessively high (Mo>0.20%), it facilitates the formation of low-temperature phase transformation structures in the welding heat-affected zone to preserve the prior austenite grain boundary and seriously deteriorates the resistance to zinc-induced crack of the steel plate; therefore, the Mo content is controlled between 0.05% and 0.20%.

The purpose of adding a trace amount of Nb element to the steel is to perform a controlled rolling without recrystallization; when the addition amount of Nb is lower than 0.015%, the controlled rolling cannot play an effective role; when the addition amount of Nb exceeds 0.035%, it induces the formation of upper bainite ($B_I$, $B_{II}$) under the condition of high heat input welding to preserve the prior austenite grain boundary and seriously deteriorates the low-temperature toughness and resistance to zinc-induced crack of the heat-affected zone (HAZ) under ultra-high heat input welding; therefore, the Nb content is controlled between 0.015% and 0.035%, which does not impair the toughness and resistance to zinc-induced crack of the HAZ under high heat input welding while obtaining an optimal controlled rolling effect.

The purpose of adding a trace amount of Ti to the steel is to combine with N in the steel to produce TiN particles having a very high stability, inhibit the growth of austenite grains in the welding HAZ zone and change the secondary phase transformation product, improve the weldability of the steel, refine the size of the prior austenite grains in the welding heat-affected zone, increase the area of the grain boundary, decrease the diffusion amount of Zn on a unit grain boundary; secondly, the TiN particles facilitate the nucleation and growth of ferrite, eliminate the prior austenite grain boundary and substantially improve the resistance to zinc-induced crack of the steel plate while reducing the size of the austenite grains in the welding heat-affected zone. The content of the Ti added in the steel needs to be matched with the N content in the steel, the matching principle is that TiN cannot precipitate in the liquid steel and must precipitate in a solid phase; therefore, the precipitation temperature of TiN must be ensured to be lower than 1400° C.; when the content of the added Ti is excessively low (<0.008%), the number of the formed TiN particles is insufficient to inhibit the growth of austenite grains in the HAZ and change the secondary phase transformation product so as to improve the low-temperature toughness of the HAZ; when the content of the added Ti is excessively high (>0.018%), the precipitation temperature of TiN exceeds 1400° C., during the solidification of the liquid steel, large-size TiN particles may also precipitate, such large-size TiN particles become the starting point for crack initiation rather than inhibiting the austenite grain growth of the HAZ; therefore, the optimal controlled range of Ti content is 0.008%-0.018%.

The controlled range of N corresponds to the controlled range of Ti, and for the high heat input welding of a steel plate, the Ti/N is optimally between 1.5 and 3.4. If the N content is excessively low, the produced TiN particles are in a low amount and a large size, cannot function to improve the weldability of the steel, and instead is harmful to the weldability; however, if the N content is excessively high, free [N] in the steel increases, especially under the condition of high heat input welding, the free [N] content in the heat-affected zone (HAZ) rapidly increases, and seriously impairs the low-temperature toughness of the HZA and deteriorates the weldability of the steel. Therefore, the N content is controlled at ≤0.0060%.

By performing a Ca treatment on the steel, on one hand, the liquid steel can be further purified, and on the other hand, the sulphides in the steel are subjected to a denaturating treatment to become non-deformable, stable and tiny spherical sulphides, thereby inhibiting the hot brittleness of S, enhancing the low-temperature toughness and Z-directional property of the steel and improving the anisotropy of the toughness of the steel plate. The addition amount of Ca depends on the content of S in the steel; if the addition amount of Ca is excessively low, the treatment effect is insignificant; and if the addition amount of Ca is excessively high, the size of the formed Ca(O,S) is excessively large, the brittleness is also increased, which can become the starting point of fractural cracks, the low-temperature toughness of the steel is decreased, and meanwhile the purity of the steel quality is reduced and the liquid steel is contaminated. Generally the Ca content is controlled according to ESSP=(% Ca)[1−124(% O)]/1.25(% S), wherein ESSP is a shape control index of sulphide inclusions, and should be in the value range of between 0.5 and 5, and therefore the suitable range of the Ca content is 0.0010%-0.0040%.

The method for manufacturing the steel plate resistant to zinc-induced crack of the present invention comprises the following steps:

1) smelting and casting a slab is formed by smelting and continuous casting according to the above-mentioned components, and using a light reduction technique, the light reduction rate for continuous casting is controlled between 2% and 5%, the pouring temperature of a tundish is between 1530° C. and 1560° C., and the withdrawal speed is 0.6 m/min-1.0 m/min;

2) heating, the heating temperature of the slab is 1050° C.-1150° C., the slab is descaled with high pressure water after being removed from the furnace, and the descaling can be repeated if it is incomplete;

3) rolling a first stage is a normal rolling, wherein the maximum capacity of a rolling mill is used for an uninterrupted rolling, the pass reduction rate is ≥10%, the accumulated reduction rate is ≥45%, and the final rolling temperature is ≥980° C.;

a second stage adopts a controlled rolling in an austenite single phase region, wherein the initial rolling temperature of the controlled rolling is 800° C.-850° C., the pass reduction rate of the rolling is ≥8%, the accumulated reduction rate is ≥50%, and the final rolling temperature is 760° C.-800° C.;

4) cooling after the controlled rolling is finished, the steel plate is immediately transported to an ACC equipment at a maximum transportation speed of the roller bed, and subsequently the steel plate is subjected to an accelerated cooling; the initial cooling temperature of the steel plate is 750° C.-790° C., the cooling rate is ≥5° C./s, the stop-cooling temperature is 350° C.-550° C., and thereafter the steel plate with a thickness of ≥25 mm is naturally air-cooled to not less than 300° C., and then slow-cooled and dehydrogenated, the slow cooling process consisting in maintaining the steel plate at not less than 300° C. for at least 36 hours.

In the manufacturing method of the present invention:

according to the components of the steel type and the features of the manufacturing process of the present invention, the present invention adopts a continuous casting process and a light reduction technique, with the light reduction rate of continuous casting being controlled between 2% and 5%, the key point of the continuous casting process is to control the pouring temperature of tundish and the withdrawal speed, the pouring temperature of the tundish is between 1530° C. and 1560° C., and the withdrawal speed is 0.6 m/min-1.0 m/min.

The heating temperature of the slab is 1050° C.-1150° C., the slab is descaled with high pressure water after being removed from the furnace, and the descaling can be repeated if it is incomplete; after the descaling is finished, a first stage rolling is subsequently carried out;

the first stage is a normal rolling, wherein the maximum capacity of a rolling mill is used for an uninterrupted rolling, the pass reduction rate is ≥10%, the accumulated reduction rate is ≥45%, and the final rolling temperature is ≥980° C., such that the deformed metal is ensured to perform a dynamic/static recrystallization, and the austenite grains are refined.

A second stage adopts a controlled rolling in an austenite single phase region, wherein the initial rolling temperature of the controlled rolling is 800° C.-850° C., the pass reduction rate of the rolling is ≥8%, the accumulated reduction rate is ≥50%, and the final rolling temperature is 760° C.-800° C.

After the controlled rolling is finished, the steel plate is immediately transported to an accelerated cooling equipment to perform an accelerated cooling on the steel plate; the initial cooling temperature of the steel plate is 750° C.-790° C., the cooling rate is ≥5° C./s, the stop-cooling temperature is 350° C.-550° C., and thereafter the steel plate with a thickness of ≥25 mm is naturally air-cooled to not less than 300° C., and then slow-cooled and dehydrogenated, the slow cooling process consisting in maintaining the steel plate at not less than 300° C. for at least 36 hours.

Through the above-mentioned component design and the implementation of a large-scale production process on site, the micro-structure of the steel plate is tiny ferrite+bainite colonies dispersedly distributed, with an average grain size of not greater than 10 μm, obtaining homogeneous and excellent mechanical properties, excellent weldability and resistance to zinc-induced crack, and is thus especially suitable as a zinc-spray coated corrosion-resistant steel plate for marine structures, a zinc-spray corrosion-resistant steel plate for extra-high voltage power transmission structures, a zinc-spray coated corrosion-resistant steel plate for coast bridge structures, and the like.

The present invention has the following beneficial effects:

Through the combinational design of alloy elements and the strict control of residual B element in the steel, and the match with a suitable TMCP process, the present invention guarantees that the micro-structure of the finished steel plate is ferrite+bainite colonies which are tiny and dispersedly and homogeneously distributed, with an average grain size controlled at not greater than 10 μm, and the micro-structure of the welding heat-affected zone is tiny homogeneous ferrite+a small amount of pearlite; more importantly, the austenite grain boundary formed at high temperature during the weld thermal cycle is completely eliminated, while ensuring the good mechanical properties and weldability of the steel plate as the base material, the welded joints, especially the welding heat-affected zone, of the steel plate has an excellent zinc-induced-crack-resistance, the organic unity of the high strength, good weldability and zinc-induced-crack-resistance is achieved, and the steel plate is particularly suitable as a zinc-spray coated corrosion-resistant steel plate for marine structures, a zinc-spray corrosion-resistant steel plate for extra-high voltage power transmission structures, a zinc-spray coated corrosion-resistant steel plate for coast bridge structures, and the like.

Furthermore, the present invention is implemented through an on-line TMCP control process, and the quenched-tempered heat treatment process is eliminated; not only the manufacturing cycle of the steel plate is shortened and the manufacturing costs of the steel plate is decreased, but also the production organization difficulty of the steel plate is reduced, and the production operating efficiency is improved; the relatively low noble alloy component design (especially the contents of Cu, Ni and Mo) greatly reduces the alloy costs of the steel plate; the ultra low C content, and low carbon equivalent and Pcm index greatly improve the weldability of the steel plate, especially high heat input weldability, thereby substantially enhancing the manufacturing efficiency of the on-site welding for users, saving the member-manufacturing costs for users, shortening the member-manufacturing time for users and creating great values for users; therefore such a steel plate is not only a high value-added and green and environmentally friendly product.

DESCRIPTION OF THE DRAWINGS

FIG. 1 is the micro-structure of the steel in example 5 of the invention.

DETAILED DESCRIPTION OF THE INVENTION

The present invention is further illustrated below in conjunction with the embodiments and the drawings.

See table 1 for the components of the steels in the embodiments of the present invention, and see tables 2 and 3 for the manufacturing process of the steels in the embodiments. Table 4 is the properties of the steels in the embodiments of the present invention.

As shown in FIG. 1, the micro-structure of the finished steel plate of the present invention is ferrite+bainite colonies which are tiny and dispersedly and homogeneously distributed, with an average grain size controlled at not greater than 10 μm, and the micro-structure of the welding heat-affected zone is tiny and homogeneous ferrite+a small amount of pearlite.

In the present invention, through the combinational design of alloy elements and the strict control of residual B element in the steel, and the match with a suitable TMCP process, while ensuring the good mechanical properties and weldability of the steel plate as the base material, the welded joints, especially the welding heat-affected zone, of the steel plate has an excellent zinc-induced-crack-resistance, the organic unity of the high strength, good weldability and zinc-induced-crack-resistance is achieved, and the steel plate is particularly suitable as a zinc-spray coated corrosion-resistant steel plate for marine structures, a zinc-spray corrosion-resistant steel plate for extra-high voltage power transmission structures, a zinc-spray coated corrosion-resistant steel plate for coast bridge structures, and the like. Furthermore, the technique of the present invention is implemented through an on-line TMCP control process, the quenched-tempered heat treatment process is eliminated; not only the manufacturing cycle of the steel plate is shortened and the manufacturing costs of the steel plate is decreased, but also the production organization difficulty of the steel plate is reduced, and the production operating efficiency is improved; the relatively low noble alloy component design (especially the contents of Cu, Ni and Mo) greatly reduces the alloy costs of the steel plate; the ultra low C content, and low carbon equivalent and Pcm index greatly improve the weldability of the steel plate, especially high heat input weldability, thereby substantially enhancing the manufacturing efficiency of the on-site welding for users, saving the member-manufacturing costs for users, shortening the member-manufacturing time for users and creating great values for users; therefore such a steel plate is not only a high value-added and green and environmentally friendly product. The successful implementation of the technology in this patent marks that Baosteel makes a new breakthrough in the aspect of the key manufacturing technology of zinc-induced-crack-resistance steel plate, which improves the brand image and market competitiveness of the thick plate of Baosteel; it is not necessary to add any equipment during the production of a 550 MPa high-strength steel plate in the present invention, the manufacturing process is simple and the production process is easily controlled, and therefore, the manufacturing costs are low, and a very high cost performance and market competitiveness are achieved; and this technology has a strong adaptability, can be promoted to all the medium and heavy plate manufacturers having thermal treatment equipment, and has a very strong commercial popularization and a relatively high technology trade value.

With the development of national economy in our country, the requirement of building an economical and harmonious society and the energy development have been put on the agenda, the ocean exploitation by humans is the most important; the steel plates for large-scale marine structures, offshore drilling platforms, drilling derricks and cross-sea bridges all need to spray zinc for anti-corrosion, the steel plate resistant to zinc-induced crack has a broad market prospect, and the 550 MPa-grade steel plate resistant to zinc-induced crack is still a bran-new steel type in our country; except for Baosteel, other iron and steel enterprises in our country never investigated and trial-manufactured. At present, this type of steel has been successfully trial-manufactured in Baosteel, and each mechanical performance index, weldability and zinc-induced-crack resistance thereof have reached an international advanced level.

TABLE 1

Unit: weight percentage

| Steel sample | C | Si | Mn | P | S | Cu | Ni | Mo | Nb | Ti | N | Ca | B | Fe and impurities |
|---|---|---|---|---|---|---|---|---|---|---|---|---|---|---|
| Example 1 | 0.05 | 0.17 | 1.38 | 0.013 | 0.0017 | 0.10 | 0.20 | 0.05 | 0.015 | 0.008 | 0.0043 | 0.0019 | 0.0002 | the balance |
| Example 2 | 0.07 | 0.11 | 1.35 | 0.010 | 0.0008 | 0.16 | 0.25 | 0.09 | 0.020 | 0.011 | 0.0038 | 0.0022 | 0.0001 | the balance |
| Example 3 | 0.06 | 0.20 | 1.50 | 0.011 | 0.0030 | 0.25 | 0.40 | 0.12 | 0.027 | 0.015 | 0.0046 | 0.0030 | 0.0001 | the balance |
| Example 4 | 0.09 | 0.10 | 1.60 | 0.007 | 0.0014 | 0.22 | 0.45 | 0.16 | 0.032 | 0.017 | 0.0053 | 0.0040 | / | the balance |
| Example 5 | 0.07 | 0.09 | 1.65 | 0.008 | 0.0009 | 0.30 | 0.50 | 0.20 | 0.035 | 0.018 | 0.0060 | 0.0010 | / | the balance |

TABLE 2

| | | | | | 1st stage rolling | | | 2nd stage controlled rolling | | | |
|---|---|---|---|---|---|---|---|---|---|---|---|
| Steel sample | Light reduction rate (%) | Pouring temperature of tundish (° C.) | Withdrawal speed (m/min) | Heating temperature (° C.) | Pass reduction rate (%) | Accumulated reduction rate (%) | Final rolling temperature (° C.) | Controlled rolling temperature (° C.) | Final rolling temperature (° C.) | Pass reduction rate (%) | Accumulated reduction rate (%) |
| Example 1 | 3 | 1560 | 1.0 | 1150 | 13 | 80 | 980 | 850 | 760 | 9 | 75 |
| Example 2 | 2 | 1545 | 0.9 | 1130 | 10 | 75 | 995 | 830 | 775 | 8 | 75 |
| Example 3 | 5 | 1530 | 0.7 | 1100 | 11 | 60 | 1000 | 820 | 800 | 8 | 60 |
| Example 4 | 4 | 1550 | 0.8 | 1080 | 10 | 45 | 990 | 810 | 790 | 9 | 55 |
| Example 5 | 3 | 1535 | 0.6 | 1050 | 12 | 50 | 1010 | 800 | 780 | 9 | 50 |

TABLE 3

| | Controlled cooling process | | | Slow cooling process | |
|---|---|---|---|---|---|
| Steel sample | Initial cooling temperature (° C.) | Cooling rate (° C./s) | Stop-cooling temperature (° C.) | Slow cooling temperature (° C.) | Slow cooling time (hr.) |
| Example 1 | 750 | 25 | 550 | Natural air cooling | / |
| Example 2 | 765 | 15 | 500 | 311 | 36 |
| Example 3 | 790 | 8 | 430 | 323 | 40 |
| Example 4 | 780 | 6 | 400 | 335 | 40 |
| Example 5 | 770 | 5 | 350 | 357 | 48 |

TABLE 4

| Steel sample | Product plate thickness (mm) | YP MPa | TS MPa | δ % | Akv (−40° C.) J | Welding preheating temperature (° C.) | $S_{LM}$ (%) | Note |
|---|---|---|---|---|---|---|---|---|
| Example 1 | 12 | 535 | 617 | 23 | 332, 367, 355; 351 | ≤0 | 63 | no occurrence of zinc-induced cracks |
| Example 2 | 25 | 527 | 623 | 25 | 363, 375, 344; 361 | ≤0 | 57 | no occurrence of zinc-induced cracks |
| Example 3 | 50 | 519 | 621 | 25 | 355, 349, 366; 357 | ≤0 | 60 | no occurrence of zinc-induced cracks |
| Example 4 | 65 | 530 | 636 | 26 | 324, 335, 348; 336 | ≤0 | 52 | no occurrence of zinc-induced cracks |
| Example 5 | 80 | 522 | 608 | 25 | 293, 303, 317; 304 | ≤0 | 50 | no occurrence of zinc-induced cracks |

Note:

$S_{LM}$ = (the breaking strength of a galvanized tensile test bar containing periphery notches/the breaking strength of an un-galvanized tensile test bar containing periphery notches) × 100%, and $S_{LM}$ ≥ 42% indicates no occurrence of zinc-induced cracks.

What is claimed is:

1. A steel plate consisting of in weight percentages:

C: 0.05%-0.090%;

Si: ≤0.20%;

Mn: 1.35%-1.65%;

P: ≤0.013%;

S: ≤0.003%;

Cu: 0.10%-0.30%;

Ni: 0.20%-0.50%;

Mo: 0.05%-0.20%;

Nb: 0.015%-0.035%;

Ti: 0.008%-0.018%;

N: ≤0.0060%;

Ca: 0.0010%-0.0040%;

B: ≤0.0002%, and the balance being Fe and inevitable impurities;

and at the same time the contents of the above-mentioned elements must satisfy the relationships as follows:

Mn/C≥15;

[(% Mn)+0.75(% Mo)]×(% C)≤0.16;

CEZ≤0.44%, wherein,

CEZ=C+Si/17+Mn/7.5+Cu/13+Ni/17+Cr/4.5+Mo/3+V/1.5+Nb/2+Ti/4.5+420B;

Ni/Cu≥1.50;

Nb/Ti≥1.8, and TUN is between 1.50 and 3.40;

Ca/S is between 1.00 and 3.00, and $(\%\ Ca)\times(\%\ S)^{0.28}\leq 1.0\times 10^{-3}$;

wherein the finished steel plate has a yield strength of ≥460 MPa, a tensile strength of ≥550 MPa, and a single value of an impact energy at −60° C. of ≥47 J, the micro-structure of the finished steel plate is ferrite and bainite colonies which are tiny and dispersedly and homogeneously distributed, with an average grain size controlled at not greater than 10 μm, and the micro-structure of a welding heat-affected zone is tiny and homogeneous ferrite and a small amount of pearlite;

and wherein the $S_{LM}$ of the steel plate is ≥42%, wherein $S_{LM}$=(the breaking strength of a galvanized tensile test bar containing periphery notches/the breaking strength of an un-galvanized tensile test bar containing periphery notches)×100%.

2. A method for manufacturing the steel plate resistant to zinc-induced crack of claim 1, comprising the following steps:

smelting and casting:

a slab is formed by smelting and continuous casting according to the above-mentioned components and using a light reduction technique, the light reduction rate for continuous casting is controlled between 2% and 5%, the pouring temperature of a tundish is between 1530° C. and 1560° C., and the withdrawal speed is 0.6 m/min-1.0 m/min;

heating: the heating temperature of the slab is 1050° C.–1150° C., the slab is descaled with high pressure water after being removed from the furnace, and the descaling can be repeated if it is incomplete;

rolling:

a first stage is a normal rolling, wherein the maximum capacity of a rolling mill is used for an uninterrupted rolling, the pass reduction rate is ≥10%, the accumulated reduction rate is ≥45%, and the final rolling temperature is ≥980° C.; and a second stage adopts a controlled rolling in an austenite single phase region, wherein the initial rolling temperature of the controlled rolling is 800° C.–850° C., the pass reduction rate of the rolling is ≥8%, the accumulated reduction rate is ≥50%, and the final rolling temperature is 760° C.–800° C.;

and cooling:

after the controlled rolling is finished, the steel plate is immediately transported to accelerated cooling equipment to perform accelerated cooling on the steel plate, wherein the initial cooling temperature of the steel plate is 750° C.–790° C., the cooling rate is ≥5° C./s, the stop-cooling temperature is 350° C.–550° C., and thereafter the steel plate with a thickness of ≥25 mm is naturally air-cooled to not less than 300° C., and then slow-cooled and dehydrogenated, the slow cooling process consisting in maintaining the steel plate at not less than 300° C. for at least 36 hours; and the steel plate with a thickness of <25 mm is naturally air-cooled to room temperature.

3. The steel plate of claim 1, wherein the steel plate is a zinc-spray coated steel plate for marine structures, a zinc-spray steel plate for extra-high voltage power transmission structures, or a zinc-spray coated steel plate for coast bridge structures.

* * * * *